US008322180B1

(12) United States Patent
Renwick

(10) Patent No.: US 8,322,180 B1
(45) Date of Patent: Dec. 4, 2012

(54) METAL BENDING APPARATUS

(76) Inventor: James D. Renwick, Erie, PA (US)

( * ) Notice: Subject to any disclaimer, the term of this patent is extended or adjusted under 35 U.S.C. 154(b) by 1032 days.

(21) Appl. No.: 12/266,003

(22) Filed: Nov. 6, 2008

(51) Int. Cl.
*B21D 11/00* (2006.01)

(52) U.S. Cl. ..... 72/319; 72/321

(58) Field of Classification Search ..... 72/319, 72/320–323
See application file for complete search history.

(56) References Cited

U.S. PATENT DOCUMENTS

| | | | | |
|---|---|---|---|---|
| 1,527,547 | A | 2/1925 | Goeler | |
| 2,217,378 | A | 10/1940 | Nilsby | |
| 2,279,654 | A | 4/1942 | Carter | |
| 2,401,031 | A | 5/1946 | Wanasek | |
| 2,436,278 | A | 2/1948 | Willett | |
| 5,819,577 | A * | 10/1998 | D'Arcy | 72/321 |
| 6,003,357 | A * | 12/1999 | Brown | 72/319 |
| 6,854,314 | B2 * | 2/2005 | Cleave et al. | 72/319 |
| 6,901,783 | B2 * | 6/2005 | Clark | 72/319 |

* cited by examiner

*Primary Examiner* — Dana Ross
*Assistant Examiner* — Mohammad I Yusuf

(57) ABSTRACT

The metal bending apparatus is an easily portable apparatus with substantial frame integrity. The vertical plate of the apparatus removably receives any of a plurality of different diameter nodes. Each node enables a different radius to be bent into existing sheet metal. While the ideal embodiment features node diameters of ¾ inch, 1 inch, 1 1/16 inch, and 1¾ inch, the nodes are not limited to these diameters only. To bend sheet metal, an edge of the metal is removably secured to the back side of the vertical plate via the metal retainer. The pivoting assembly is then pivoted over the metal and downwardly toward the front of the frame. The metal is thereby bent to the desired radius.

6 Claims, 6 Drawing Sheets

METAL BENDING APPARATUS

BACKGROUND OF THE INVENTION

A variety of various metal brakes have been provided in the past. The present apparatus provides a basic and portable apparatus for bending sheet metal in a plurality of radius bends, with quickly interchangeable nodes for varying the radius.

FIELD OF THE INVENTION

The metal bending apparatus relates to metal brakes and more especially to a metal bending apparatus with interchangeable nodes for selectively bending a plurality of radii in metal.

SUMMARY OF THE INVENTION

The general purpose of the metal bending apparatus, described subsequently in greater detail, is to provide a metal bending apparatus which has many novel features that result in an improved metal bending apparatus which is not anticipated, rendered obvious, suggested, or even implied by prior art, either alone or in combination thereof.

To attain this, the metal bending apparatus is an easily portable apparatus with substantial frame integrity. The vertical plate of the apparatus removably receives any of a plurality of different diameter nodes. Each node enables a different radius to be bent into existing sheet metal. While the ideal embodiment features node diameters of ¾ inch, 1 inch, 1 1/16 inch, and 1¾ inch, the nodes are not limited to these diameters only. To bend sheet metal, an edge of the metal is removably secured to the back side of the vertical plate via the metal retainer. The pivoting assembly is then pivoted over the metal and downwardly toward the front of the frame. The metal is thereby bent to the desired radius.

Thus has been broadly outlined the more important features of the improved metal bending apparatus so that the detailed description thereof that follows may be better understood and in order that the present contribution to the art may be better appreciated.

An object of the metal bending apparatus is to bend sheet metal.

Another object of the metal bending apparatus is to bend sheet metal in a variety of bend radii.

A further object of the metal bending apparatus is to be easily portable.

An added object of the metal bending apparatus is to easily change between selected bending radii.

Another object of the metal bending apparatus is to provide a sturdy frame.

Yet another object of the metal bending apparatus is to provide a sturdy pivoting assembly.

These together with additional objects, features and advantages of the improved metal bending apparatus will be readily apparent to those of ordinary skill in the art upon reading the following detailed description of presently preferred, but nonetheless illustrative, embodiments of the improved metal bending apparatus when taken in conjunction with the accompanying drawings.

In this respect, before explaining the current embodiments of the improved metal bending apparatus in detail, it is to be understood that the metal bending apparatus is not limited in its application to the details of construction and arrangements of the components set forth in the following description or illustration. Those skilled in the art will appreciate that the concept of this disclosure may be readily utilized as a basis for the design of other structures, methods, and systems for carrying out the several purposes of the improved metal bending apparatus. It is therefore important that the claims be regarded as including such equivalent constructions insofar as they do not depart from the spirit and scope of the metal bending apparatus. It is also to be understood that the phraseology and terminology employed herein are for purposes of description and should not be regarded as limiting.

DETAILED DESCRIPTION OF THE DRAWINGS

With reference now to the drawings, and in particular FIGS. 1 through 6 thereof, the principles and concepts of the metal bending apparatus generally designated by the reference number 10 will be described.

Figure 1:
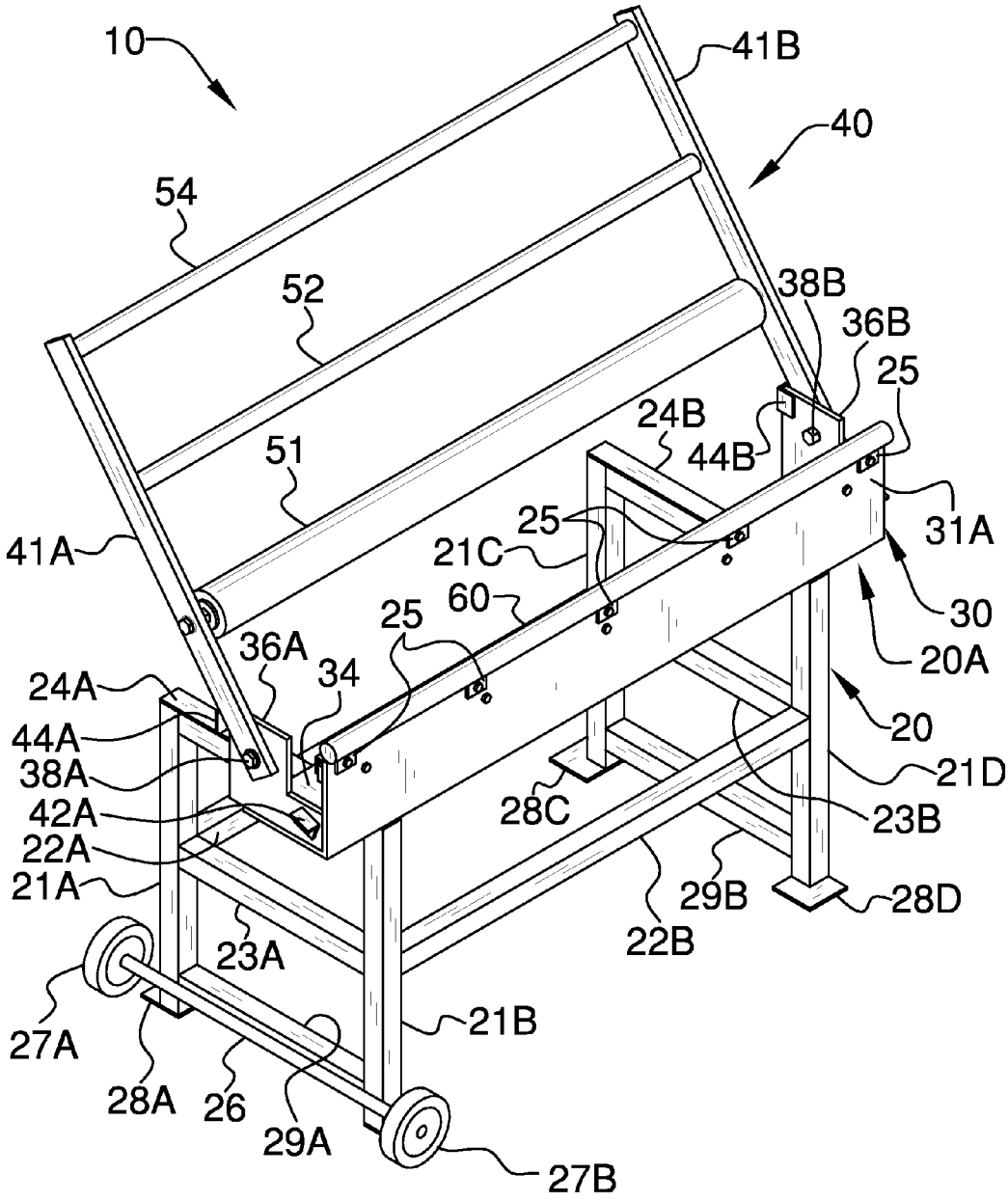
FIG. 1 is a frontal perspective view
Figure 2:
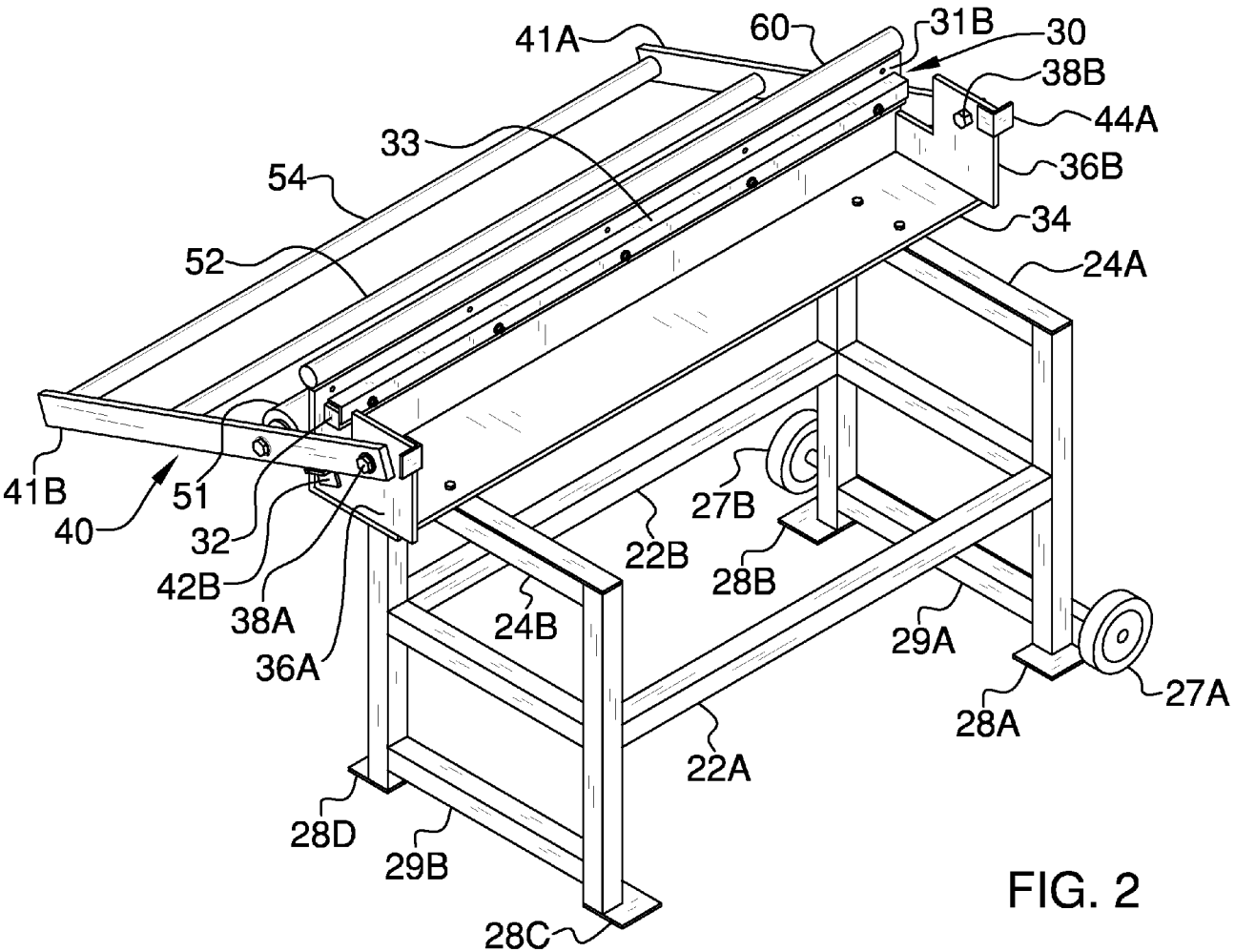
FIG. 2 is a rear perspective view.

Referring to FIGS. 1 and 2, the metal bending apparatus 10 partially comprises the portable frame 20. The frame 20 comprises the plurality of spaced apart uprights. The uprights comprise a first upright 21*a*, a second upright 21*b*, a third upright 21*c*, and a fourth upright 21*d*. A plurality of spaced apart transverses connects the first upright 21*a* to the second upright 21*b*. The transverses comprise the first bottom transverse 29*a* spaced apart from the first lower transverse 23*a*. The first upper transverse 24*a* is spaced apart from the first lower transverse 23*a*. A plurality of spaced apart transverses connects the third upright 21*c* to the fourth upright 21*d*.

The transverses comprise the second bottom transverse 29*b* spaced part from the second lower transverse 23*b*. The second upper transverse 24*b* is spaced apart from the second lower transverse 23*b*. The first longitudinal support 22*a* connects the first upright 21*a* to the third upright 21*c*. The second longitudinal support 22*b* connects the second upright 21*b* to the fourth upright 21*d*. A foot is disposed on a bottom of each upright. The first foot 28*a* is disposed on the first upright 21*a*. The second foot 28*b* is disposed on the second upright 21*b*. The third foot 28*c* is disposed on the third upright 21*c*. The fourth foot 28*d* is disposed on the fourth upright 21*d*. The axle 26 is affixed to the first upright 21*a* and the second upright 21*b*. The pair of spaced apart wheels is disposed on the axle. The first wheel 27*a* is proximal to the first upright 21*a*. The second wheel 27*b* is proximal to the second upright 21*b*. As illustrated, the ideal embodiment positions the axle 26 and wheels exteriorly to the first upright 21*a* and the second upright 21*b*. A user optionally grasps and lifts one end of the apparatus 10 via the second upper transverse 24*b*, The feet then no longer bear the weight of the apparatus 10. The weight of the apparatus 10 is thereby born on the wheels, enabling easy portability.

Figure 3:
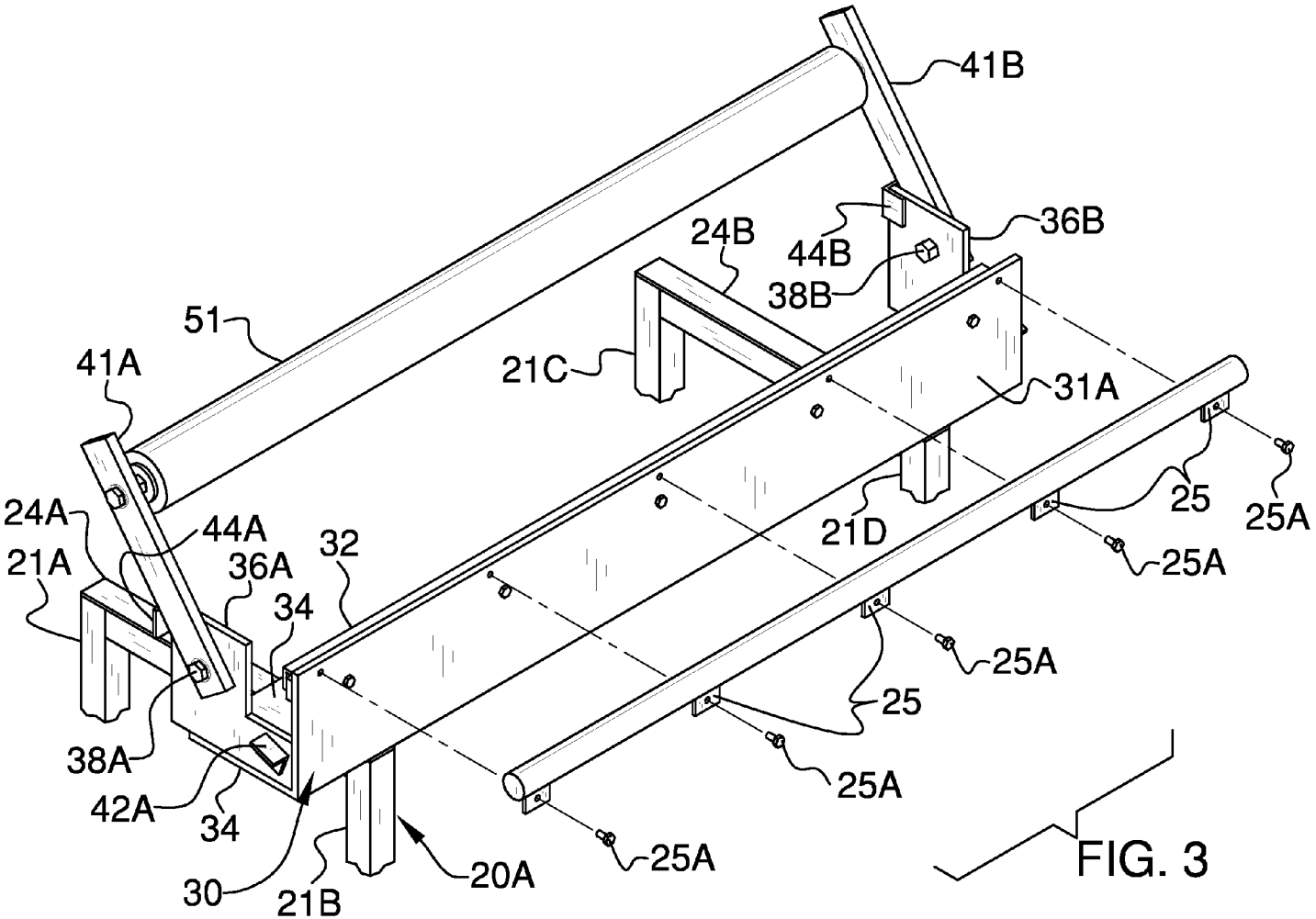
FIG. 3 is a partial frontal perspective view.
Figure 4:
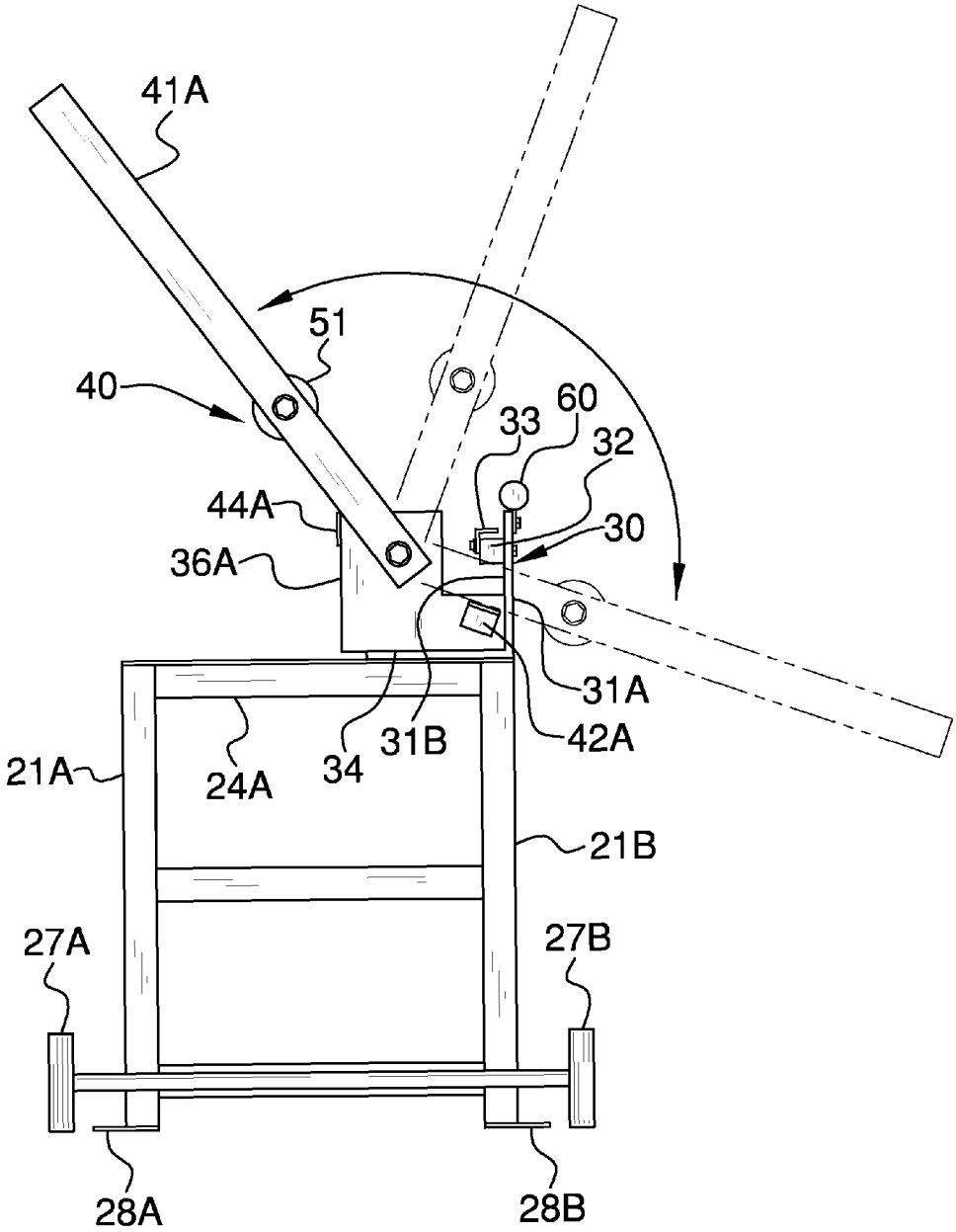
FIG. 4 is a lateral elevation view.

Referring to FIGS. 3 and 4, the vertical plate 30 has a front side 31*a* and a back side 31*b*. The back side 31*b* is connected to the frame 20 front 20*a*. The vertical plate 30 is affixed to the second upright 21*b* and the fourth upright 21*d*. The horizontal plate 34 connects the first upper transverse 24*a* and the second upright 21*b* to the second upper transverse 24*b* and the fourth upright 21*d*. The horizontal plate 34 is connected to the vertical plate 30. The horizontal plate 34 adds structural rigidity to the frame 20.

Figure 5:
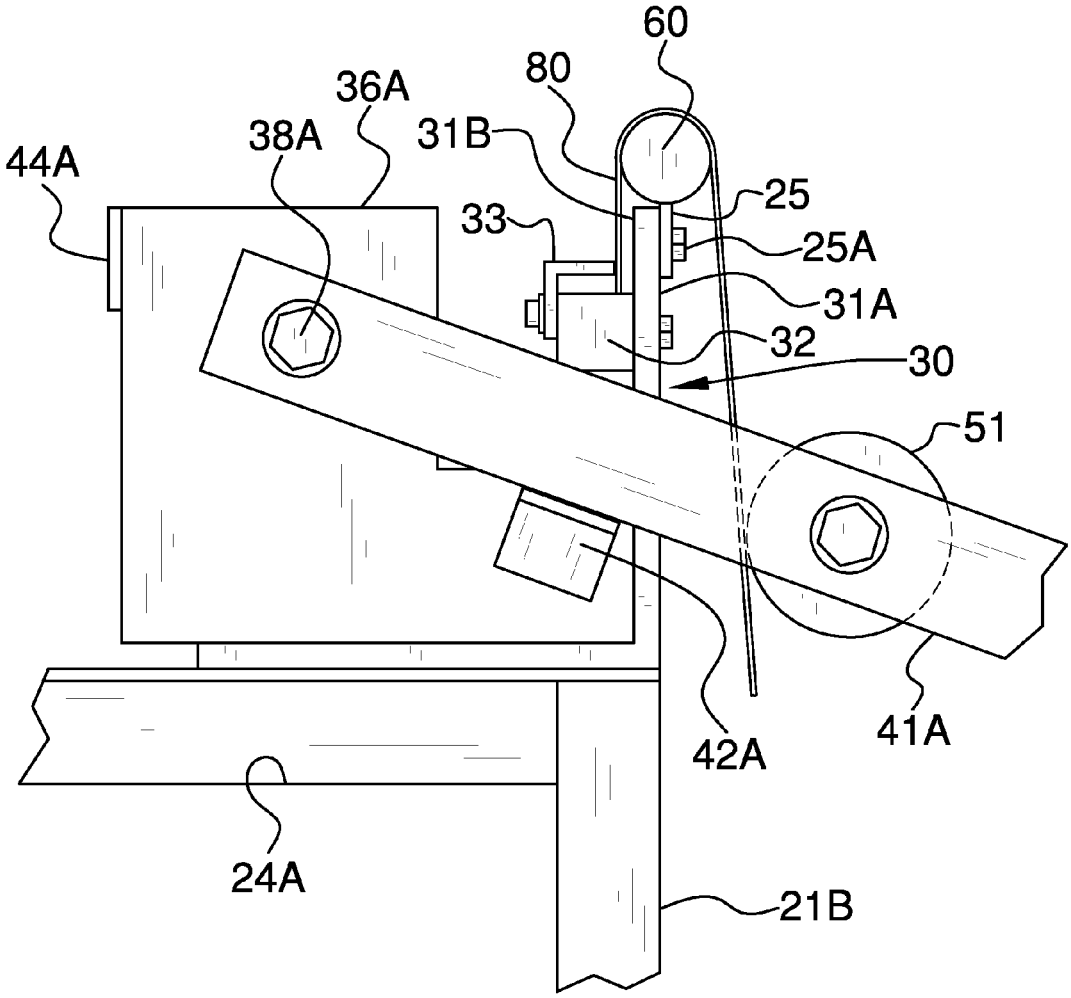
FIG. 5 is a partial lateral elevation view, in use.
Figure 6:
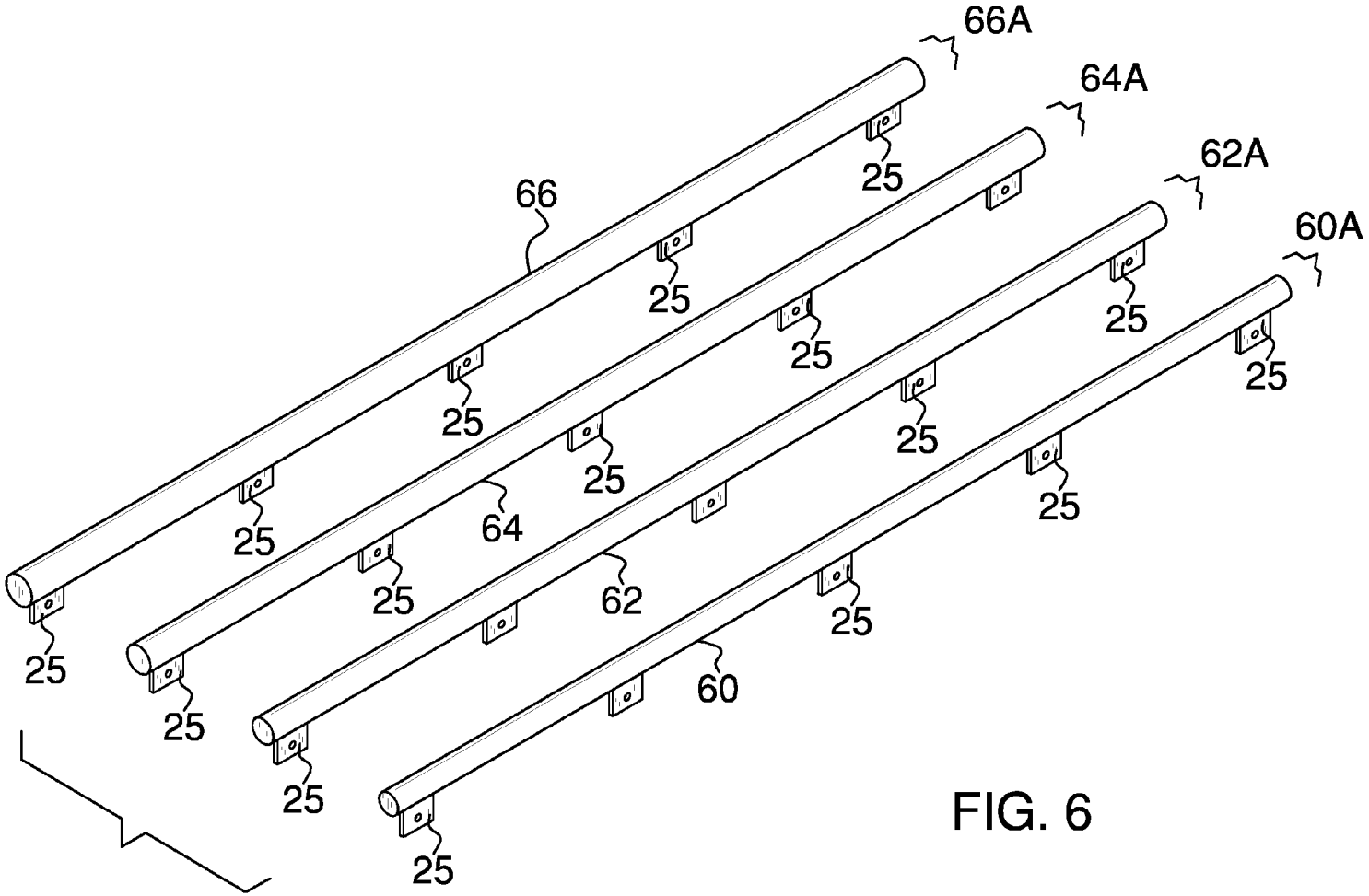
FIG. 6 is a perspective view of the plurality of nodes provided.

Referring to FIGS. 5 and 6, the plurality of round nodes is provided. Each node has a different diameter. Each node is selectively affixed to the vertical plate 30 via a plurality of mounts 25 and a fastener 25*a* for each mount. The nodes comprise the first node 60, the second node 62, the third node 64, and the fourth node 66. The first node 60 has a first node diameter 60*a* of about ¾ inch. The second node 62 has a second node diameter 62*a* of about 1 inch. The third node 64 has a third node diameter 64*a* of about 1 1/16 inch. The fourth node 66 has a fourth node diameter 66*a* of about 1¾ inch. Each node provides for bending a different radius in existing sheet metal 80. The horizontal brace 32 is affixed to the back side 31*b* of the vertical plate 30. The metal retainer 33 is affixed to the horizontal brace 32. The metal retainer 33 selectively retains an existing sheet metal 80 for bending by movement of the pivoting assembly 40. The pivoting assembly 40 forces the roller 51 over and proximal to a chosen node, then downward, thereby bending the metal 80.

Referring again to FIGS. 1, 2, and 4, the first pivot support 36*a* is vertically affixed to the first upper transverse 24*a* and the vertical plate 30. The first lower stop 42*a* is affixed to the first pivot support 36*a*. The first upper rest 44*a* is affixed to the first pivot support 36*a*. The second pivot support 36*b* is vertically affixed to the second upper transverse 24*b* and the vertical plate 30. The second lower stop 42*b* is affixed to the second pivot support 36*b*. The second upper rest 44*b* is affixed to the second pivot support 36*b*. The pivoting assembly 40 is pivotally affixed to the vertical supports via a first pivot 38*a* disposed on the first pivot support 36*a* and a second pivot 38*b* disposed on the second pivot support 36*b*.

The pivoting assembly 40 comprises the first arm 41*a* spaced apart from the second arm 41*b*. The first arm 41*a* is pivotally affixed to the first pivot support 36*a* via the first pivot 38*a*. The second arm 41*b* is pivotally affixed to the second pivot support 36*b* via the second pivot 38*b*. The first arm 41*a* is limited in downward travel by the first lower stop 42*a*. The first arm 41*a* is limited in upward travel by the first upper rest 44*a*. The second arm 41*b* is limited in downward travel by the second lower stop 42*b*. The second arm 41*b* is limited in upward travel by the second upper rest 44*b*. The roller 51 is removably affixed between the first arm 41*a* and the second arm 41*b*. Removably affixing the roller 51 provides for roller 51 change and service as needed. The roller 51 is disposed proximal to the first pivot 38*a* and the second pivot 38*b*. The handle 54 upwardly connects the first arm 41*a* to the second arm 41*b*. The arm support 52 is disposed between the roller 51 and the handle 54. The arm support 52, in the most complete embodiment as illustrated, adds rigidity to the pivoting assembly 40.

With respect to the above description then, it is to be realized that the optimum dimensional relationships for the parts of the metal bending apparatus, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the metal bending apparatus.

Directional terms such as "front", "back", "in", "out", "downward", "upper", "lower", and the like may have been used in the description. These terms are applicable to the embodiments shown and described in conjunction with the drawings. These terms are merely used for the purpose of description in connection with the drawings and do not necessarily apply to the position in which the metal bending apparatus may be used.

Therefore, the foregoing is considered as illustrative only of the principles of the metal bending apparatus. Further, since numerous modifications and changes will readily occur to those skilled in the art, it is not desired to limit the metal bending apparatus to the exact construction and operation shown and described, and accordingly, all suitable modifications and equivalents may be resorted to, falling within the scope of the metal bending apparatus.

What is claimed is:

1. A metal bending apparatus, comprising, in combination:

a portable frame comprising:

a plurality of spaced apart uprights comprising a first upright, a second upright, a third upright, and a fourth upright;

a plurality of spaced apart transverses connecting the first upright to the second upright;

a plurality of spaced apart transverses connecting the third upright to the fourth upright;

a first longitudinal support connecting the first upright to the third upright;

a second longitudinal support connecting the second upright to the fourth upright;

a foot disposed on a bottom of each upright;

an axle affixed to the first upright and the second upright;

a pair of spaced apart wheels disposed on the axle;

a vertical plate having a front side and a back side, the back side connected to a frame front, the vertical plate affixed to the second upright and the fourth upright;

a plurality of round nodes, each node having a different diameter, each node selectively affixed to the vertical plate;

a horizontal brace affixed to the back side of the vertical plate;

a metal retainer affixed to the horizontal brace, the metal retainer selectively retaining an existing sheet metal;

a first pivot support vertically affixed to the vertical plate;

a second pivot support vertically affixed to the vertical plate;

a pivoting assembly pivotally affixed to the frame via a first pivot disposed on the first pivot support and a second pivot disposed on the second pivot support, the pivoting assembly comprising:

a first arm spaced apart from a second arm, the first arm pivotally affixed to the first pivot support, the second arm pivotally affixed to the second pivot support;

a roller affixed between the first arm and the second arm, the roller disposed proximal to the first pivot and the second pivot, the roller rotatingly engaging an existing metal, wherein the roller is configured to roll over and bend the existing metal;

a handle upwardly connecting the first arm to the second arm.

2. The apparatus according to claim 1 further comprising a first lower stop affixed to the first pivot support, the first arm limited in downward travel by the first lower stop;

a second lower stop affixed to the second pivot support, the second arm limited in downward travel by the second lower stop.

3. The apparatus according to claim 1 further comprising a first upper rest affixed to the first pivot support, the first arm limited in upward travel by the first upper rest;

a second upper rest affixed to the second pivot support, the second arm limited in upward travel by the second upper rest.

4. The apparatus according to claim 2 further comprising a first upper rest affixed to the first pivot support, the first arm limited in upward travel by the first upper rest;

a second upper rest affixed to the second pivot support, the second arm limited in upward travel by the second upper rest.

5. A metal bending apparatus, comprising, in combination:

a portable frame comprising:

a plurality of spaced apart uprights comprising a first upright, a second upright, a third upright, and a fourth upright;

a plurality of spaced apart transverses connecting the first upright to the second upright, the transverses comprising a first bottom transverse spaced apart from a first lower transverse, a first upper transverse spaced apart from the first lower transverse;

a plurality of spaced apart transverses connecting the third upright to the fourth upright, the transverses comprising a second bottom transverse spaced apart from a second lower transverse, a second upper transverse spaced apart from the second lower transverse;

a first longitudinal support connecting the first upright to the third upright;

a second longitudinal support connecting the second upright to the fourth upright;

a foot disposed on a bottom of each upright;

an axle affixed to the first upright and the second upright;

a pair of spaced apart wheels disposed on the axle;

a vertical plate having a front side and a back side, the back side connected to a frame front, the vertical plate affixed to the second upright and the fourth upright;

a horizontal plate connecting the first upper transverse and the second upright to the second upper transverse and the fourth upright, the horizontal plate connected to the vertical plate;

a plurality of round nodes, each node having a different diameter, each node selectively affixed to the vertical plate via a plurality of spaced apart mounts affixed to each node, a fastener for each mount;

a horizontal brace affixed to the back side of the vertical plate;

a metal retainer affixed to the horizontal brace, the metal retainer selectively retaining an existing sheet metal;

a first pivot support vertically affixed to the first upper transverse and the vertical plate;

a first lower stop affixed to the first pivot support;

a first upper rest affixed to the first pivot support;

a second pivot support vertically affixed to the second upper transverse and the vertical plate;

a second lower stop affixed to the second pivot support;

a second upper rest affixed to the second pivot support;

a pivoting assembly pivotally affixed to the vertical supports via a first pivot disposed on the first pivot support and a second pivot disposed on the second pivot support, the pivoting assembly comprising:

a first arm spaced apart from a second arm, the first arm pivotally affixed to the first pivot support, the second arm pivotally affixed to the second pivot support, the first arm limited in downward travel by the first lower stop, the first arm limited in upward travel by the first upper rest, the second arm limited in downward travel by the second lower stop, the second arm limited in upward travel by the second upper rest;

a roller affixed between the first arm and the second arm, the roller disposed proximal to the first pivot and the second pivot, the roller rotatingly engaging an existing metal, wherein the roller is configured to roll over and bend the existing metal;

a handle upwardly connecting the first arm to the second arm;

an arm support disposed between the roller and the handle.

6. A metal bending apparatus, comprising, in combination:

a portable frame comprising:

a plurality of spaced apart uprights comprising a first upright, a second upright, a third upright, and a fourth upright;

a plurality of spaced apart transverses connecting the first upright to the second upright, the transverses comprising a first bottom transverse spaced apart from a first lower transverse, a first upper transverse spaced apart from the first lower transverse;

a plurality of spaced apart transverses connecting the third upright to the fourth upright, the transverses comprising a second bottom transverse spaced apart from a second lower transverse, a second upper transverse spaced apart from the second lower transverse;

a first longitudinal support connecting the first upright to the third upright;

a second longitudinal support connecting the second upright to the fourth upright;

a foot disposed on a bottom of each upright;

an axle affixed to the first upright and the second upright;

a pair of spaced apart wheels disposed on the axle;

a vertical plate having a front side and a back side, the back side connected to a frame front, the vertical plate affixed to the second upright and the fourth upright;

a horizontal plate connecting the first upper transverse and the second upright to the second upper transverse and the fourth upright, the horizontal plate connected to the vertical plate;

a plurality of round nodes, each node having a different diameter, each node selectively affixed to the vertical plate via a plurality of spaced apart mounts affixed to each node, a fastener for each mount, the first node consisting of a diameter of about ¾ inch, the second node consisting of a diameter of about 1 inch, the third node consisting of a diameter of about 1 1/16 inch, and the fourth node consisting of a diameter of about 1¾ inch;

a horizontal brace affixed to the back side of the vertical plate;

a metal retainer affixed to the horizontal brace, the metal retainer selectively retaining an existing sheet metal;

a first pivot support vertically affixed to the first upper transverse and the vertical plate;

a first lower stop affixed to the first pivot support;

a first upper rest affixed to the first pivot support;

a second pivot support vertically affixed to the second upper transverse and the vertical plate;

a second lower stop affixed to the second pivot support;

a second upper rest affixed to the second pivot support;

a pivoting assembly pivotally affixed to the vertical supports via a first pivot disposed on the first pivot support and a second pivot disposed on the second pivot support, the pivoting assembly comprising:

a first arm spaced apart from a second arm, the first arm pivotally affixed to the first pivot support, the second arm pivotally affixed to the second pivot support, the first arm limited in downward travel by the first lower stop, the first arm limited in upward travel by the first upper rest, the second arm limited in downward travel by the second lower stop, the second arm limited in upward travel by the second upper rest;

a roller removably affixed between the first arm and the second arm, the roller disposed proximal to the first pivot and the second pivot, the roller rotatingly engaging an existing metal, wherein the roller is configured to roll over and bend the existing metal;

a handle upwardly connecting the first arm to the second arm;

an arm support disposed between the roller and the handle.

* * * * *